US010182628B2

(12) United States Patent
Tonelli et al.

(10) Patent No.: US 10,182,628 B2
(45) Date of Patent: Jan. 22, 2019

(54) CONTAINER, OF THE TYPE OF TRUNKS, SUITCASES, TROLLEY CASES AND THE LIKE

(71) Applicant: G.T. LINE S.R.L., Frazione Crespellano (IT)

(72) Inventors: Massimo Tonelli, Casalecchio di Reno (IT); Alessio Concettoni, Ancona (IT)

(73) Assignee: G.T. LINE S.R.L., Frazione Crespellano (IT)

( * ) Notice: Subject to any disclaimer, the term of this patent is extended or adjusted under 35 U.S.C. 154(b) by 65 days.

(21) Appl. No.: 15/103,243

(22) PCT Filed: Dec. 10, 2013

(86) PCT No.: PCT/IT2013/000343
§ 371 (c)(1),
(2) Date: Jun. 9, 2016

(87) PCT Pub. No.: WO2015/087357
PCT Pub. Date: Jun. 18, 2015

(65) Prior Publication Data

US 2016/0309863 A1 Oct. 27, 2016

(51) Int. Cl.
*A45C 5/04* (2006.01)
*A45C 5/03* (2006.01)
(Continued)

(52) U.S. Cl.
CPC ..... *A45C 5/04* (2013.01); *A45C 5/03* (2013.01); *A45C 5/06* (2013.01); *A45C 5/065* (2013.01);
(Continued)

(58) Field of Classification Search
CPC .... A45C 5/04; A45C 5/03; A45C 5/06; A45C 5/065; A45C 5/143; A45C 13/02; A45C 2005/037; B25H 3/028
See application file for complete search history.

(56) References Cited

U.S. PATENT DOCUMENTS 437,716 A * 10/1890 Owens ..... A45C 5/065 190/30
1,326,114 A * 12/1919 Sullivan ..... A47G 19/2283 190/12 R
(Continued)

FOREIGN PATENT DOCUMENTS

CN 202127971 U 2/2012
WO 2013142984 A1 10/2013

OTHER PUBLICATIONS

International Search Report dated Nov. 13, 2014 re: Application No. PCT/IT2013/000343; pp. 1-6; citing: WO 2013/142984 A1, US 2012/273505 A1, US 2013/098721 A1, US D 640 868 S1, US D 643 624 S1, US 2004/163913 A1, US 2011/226003 A1 and US 2002/096844.
(Continued)

*Primary Examiner* — Tri Mai
(74) *Attorney, Agent, or Firm* — Cantor Colburn LLP

(57) ABSTRACT

A container, of the type of trunks, suitcases, trolley cases, and the like, which includes at least one first half-shell, which can be closed at a free edge thereof by a second half-shell, when the second half-shell is arranged in a first configuration, in order to define an internal compartment that is designed to accommodate objects. The second half-shell can move from the first configuration to at least one second configuration, of free access to the compartment, and vice versa.
The first half-shell has a door arranged, in a first arrangement of use, to close an opening that is provided along at
(Continued)

least one first side wall of the first half-shell and is such as to define an additional, independent, access to the compartment. The door moves between the first arrangement and at least one second arrangement, in which the door is at least partially distanced from the opening, in order to allow free access to the compartment, even when the second half-shell is arranged in the first configuration.

16 Claims, 15 Drawing Sheets

(51) Int. Cl.

| | |
|---|---|
| ***A45C 5/06*** | (2006.01) |
| ***A45C 13/02*** | (2006.01) |
| ***B25H 3/02*** | (2006.01) |
| ***A45C 5/14*** | (2006.01) |

(52) U.S. Cl.
CPC ..... *A45C 5/143* (2013.01); *A45C 13/02* (2013.01); *B25H 3/028* (2013.01); *A45C 2005/037* (2013.01)

(56) References Cited

U.S. PATENT DOCUMENTS

| | | | | | |
|---|---|---|---|---|---|
| 1,614,910 | A * | 1/1927 | Yarder | B25H 3/02 | 206/373 |
| 1,984,345 | A | 12/1934 | Kennedy | | |
| 2,739,863 | A | 3/1956 | Ferris | | |
| 4,577,773 | A * | 3/1986 | Bitel | A47B 88/90 | 206/561 |
| 4,659,154 | A * | 4/1987 | Jenkins | A01K 97/26 | 269/907 |
| 4,801,182 | A * | 1/1989 | Metcalfe | A47B 96/16 | 312/138.1 |
| 5,203,620 | A * | 4/1993 | McLennan | A47B 88/57 | 312/334.46 |
| 5,207,723 | A * | 5/1993 | Newby, Sr. | B25H 3/00 | 280/47.19 |
| 5,257,721 | A * | 11/1993 | Smith | B44D 3/04 | 206/1.7 |
| 5,344,024 | A * | 9/1994 | Cohu | A45C 5/03 | 206/526 |
| 6,736,265 | B2 * | 5/2004 | Kipper | B25H 3/023 | 206/373 |
| 6,868,967 | B2 * | 3/2005 | Lam | A45C 13/02 | 206/350 |
| D640,868 | S | 7/2011 | Jongchul | | |
| D643,624 | S | 8/2011 | Hong | | |
| 2001/0030403 | A1 * | 10/2001 | Johnson | A01K 13/00 | 280/47.26 |
| 2002/0096844 | A1 | 7/2002 | Clegg | | |
| 2002/0117414 | A1 | 8/2002 | Kipper et al. | | |
| 2004/0163913 | A1 | 8/2004 | Tschudy | | |
| 2009/0162506 | A1 * | 6/2009 | Weir | A47J 47/10 | 426/396 |
| 2009/0223971 | A1 * | 9/2009 | Moffett | B25H 3/023 | 220/500 |
| 2011/0226003 | A1 | 9/2011 | Chaney et al. | | |
| 2012/0273505 | A1 | 11/2012 | Bose | | |
| 2013/0098721 | A1 | 4/2013 | Lai | | |

OTHER PUBLICATIONS

CN office action dated Feb. 6, 2017 re: Application No. 201380081572.0; pp. 1-12; citing: CN103355904A, US2012/0273505A1, US2013/0098721A1 and CN202127971U.

* cited by examiner

CONTAINER, OF THE TYPE OF TRUNKS, SUITCASES, TROLLEY CASES AND THE LIKE

TECHNICAL FIELD

The present disclosure relates to a container, of the type of trunks, suitcases, trolley cases, and the like.

BACKGROUND

As is known, rigid containers are available on the market, of the type of trunks, suitcases and trolley cases, which are constituted by two mutually articulated half-shells of various shapes and sizes, which, in order to meet the needs of a user base that today is extremely demanding, are provided with an ever increasing number of features and accessories, for both private and professional use.

Predominantly with reference to professional users, containers such as those mentioned above are frequently used to accommodate utensils, tools and instruments of various types and transport them to the workplace.

In such context, accessories that are now considered essential must certainly be considered to include elements such as pockets, dividers, and holding elements of various types, which make it possible to accommodate in an orderly fashion the objects placed in the internal compartment of the container, thus facilitating their retrieval and extraction when their use is required.

In parallel, rigid containers are widespread which, thanks to a suitable choice of the materials used and of the bonding methods between the various parts that go to make it up, are capable of ensuring a high level of resistance to shocks and a total hermetic seal.

Containers that are thus capable of ensuring both the performance levels cited in the previous paragraph, and also the orderly organization of the instruments accommodated therein, are found to be very useful, and in great demand, in widely varying contexts, and for example on all occasions when, despite unfavorable environmental conditions (and/or there is a high risk of shocks and stresses of various types), workers and specialist personnel need to be able to transport and use utensils and apparatuses that are particularly fragile or delicate.

However, such implementation solutions are not devoid of drawbacks.

In fact, especially when the number of tools and utensils to be transported is very high, even by resorting to pockets or dividers it is often difficult, if not impossible, to arrange them all stably and/or in an orderly fashion in the internal compartment of the container.

Usually therefore, in larger containers the utensils and tools end up being piled in multiple layers (or in any case amassed in a disorderly manner) and thus the user who wants to retrieve those items that are located lower down, after rotating the upper half-shell in order to have access to the compartment, is forced to engage in a laborious activity of first searching through and/or removing the other objects on top, thus leading to needless and bothersome wastes of time.

Furthermore, in professional applications that involve carrying out operations at preestablished points and with the aid of specific tools (for installation, maintenance, control etc.), after the arrival at the preestablished site with the container, the need is sometimes felt to be able to extract entire kits of such utensils or tools (or in any case a predefined quantity thereof) from the container, in order to then move around freely with these, without being encumbered or hindered by the need to have to move the entire container.

It thus appears evident that containers of the type described, which are often very cumbersome and heavy (in order to be able to ensure the necessary space for accommodating a lot of tools and instruments and ensure the desired resistance to shocks), are found to be wholly inadequate for the needs described above.

SUMMARY

The aim of the present disclosure is to solve the above mentioned problems, by providing a container that makes it possible to arrange the objects accommodated inside it in a practical manner.

Within this aim, the disclosure provides a container that makes possible an ordered placement of the objects to be accommodated inside it.

The disclosure also provides a container that allows, in a practical manner, the extraction and insertion of a predefined plurality of objects.

The disclosure further provides a container that ensures a high reliability of operation.

The disclosure also provides a container that can be easily implemented using elements and materials that are readily available on the market.

The disclosure further provides a container that is low cost and safely applied.

The disclosure provides a container, of the type of trunks, suitcases, trolley cases, and the like, which comprises at least one first half-shell, which can be closed at a free edge thereof by a second half-shell, when it is arranged in a first configuration, in order to define an internal compartment that is designed to accommodate objects, said second half-shell being able to move from said first configuration to at least one second configuration, of free access to said compartment, and vice versa, characterized in that said first half-shell has a door arranged, in a first arrangement of use, to close an opening that is provided along at least one first side wall of said first half-shell and defines an additional, independent access to said compartment, said door being able to move between said first arrangement and at least one second arrangement, in which it is at least partially distanced from said opening, in order to allow free access to the compartment even when said second half-shell is arranged in said first configuration.

BRIEF DESCRIPTION OF THE DRAWINGS

Further characteristics and advantages of the disclosure will become better apparent from the description of three preferred, but not exclusive, embodiments of the container according to the disclosure, which are illustrated by way of non-limiting example in the accompanying drawings wherein.

DETAILED DESCRIPTION OF THE DRAWINGS

Figure 1:
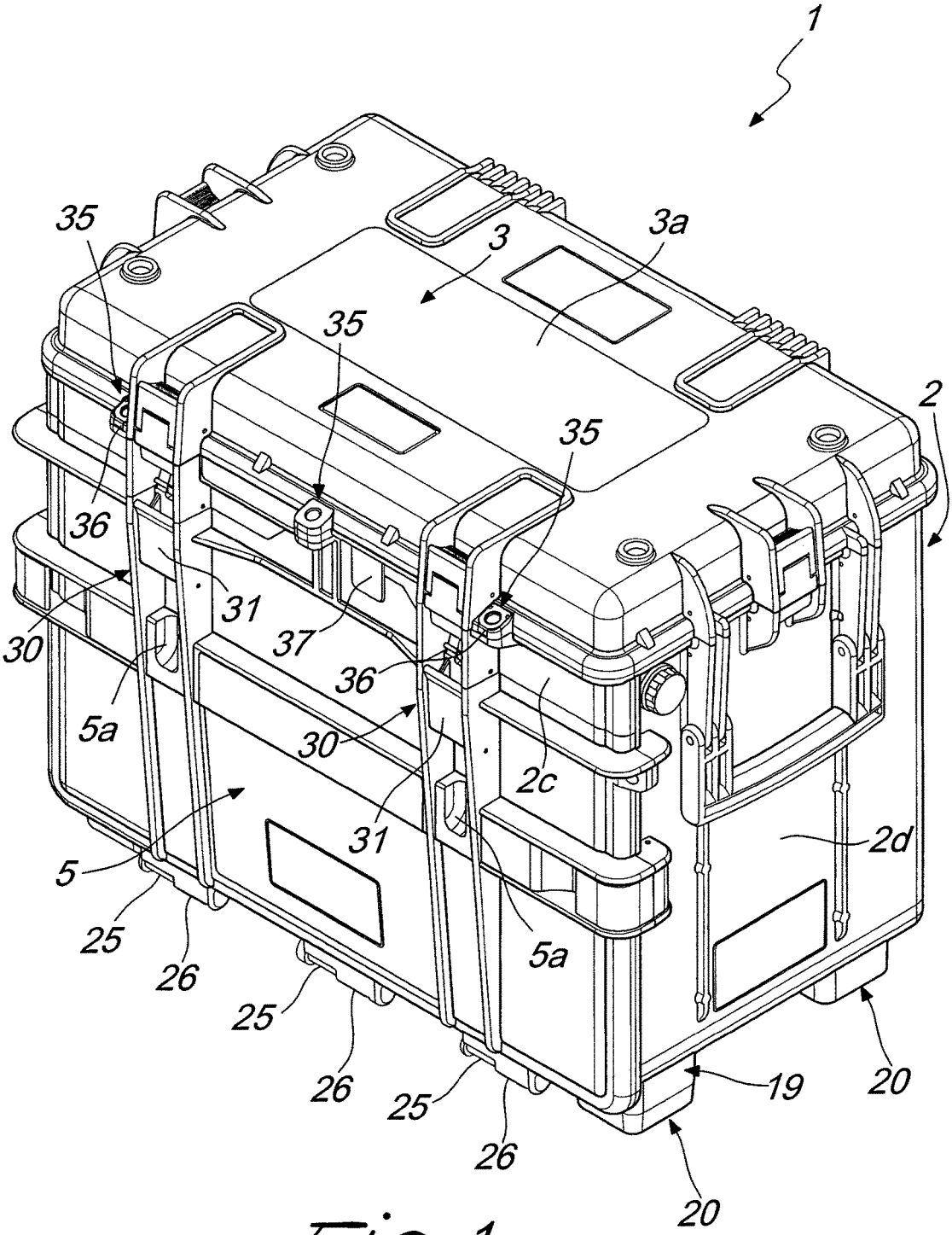
FIG. 1 is a three-quarters perspective front view of the container according to the disclosure in the first embodiment, with the second half-shell in the first configuration and the door in the first arrangement of use.

With particular reference to the figures, the reference numeral 1 generally designates a container, of the type of trunks, suitcases, trolley cases, and the like.

It should be noted from this point onward that the disclosure relates to containers 1 of any type, shape and size, and made with any materials, for both private and professional use.

In the preferred application, which thus is cited merely for the purposes of non-limiting explanation of the application of the disclosure, the container 1 is substantially a rigid trunk, made of a material with a high resistance to shocks and provided with seals and gaskets that are adapted to ensure its complete hermetic seal, and intended to transport, for professional use, tools, utensils and instruments.

The container 1 thus comprises at least one first half-shell 2, which can be closed at a free edge 2*a* thereof by a second half-shell 3, when the latter is arranged in the first configuration (illustrated in FIGS. 1 to 5), so as to define an internal compartment 4 that is designed to accommodate objects (such as for example, but not limited to, the tools, utensils and instruments mentioned previously).

Furthermore, the second half-shell 3 can be moved from the first configuration to at least one second configuration (in which the container 1 is illustrated in FIGS. 6, 7, 8, 9, 16 and 17), of free access to the compartment 4, and vice versa. In more detail, as can be seen in the accompanying figures, the second half-shell 3 is preferably, but not exclusively, articulated to the first half-shell 2 in order to be capable of transitioning (on command) from the first configuration to the second configuration, and vice versa.

According to the disclosure, the first half-shell 2 has a door 5 that is arranged, in a first arrangement of use (in which the door 5 is shown in FIGS. 1 to 5), to close an opening 2*b* which is provided along at least one first side wall 2*c* of the first half-shell 2.

In this manner, the opening 2*b* defines an additional access to the compartment 4, independent of the first (i.e. the one that is obtained through the mouth delimited by the free edge 2*a* of the first half-shell 2, and closed by the second half-shell 3 in the first configuration). The door 5 can therefore move (on command) between the first arrangement and at least one second arrangement, in which it is at least partially distanced from the opening 2*b*, in order to allow free access to the compartment 4 even when the second half-shell 3 is arranged in the first configuration.

Thus it should be noted from this point onward that the presence of the door 5 offers direct access to a different area of the compartment 4 (and furthermore, even when the latter is closed on top by the second half-shell 3), thus favoring easier retrieval (and withdrawal) of instruments, utensils, tools, and objects in general, which are accommodated in the compartment 4, and in fact achieving the set aim from this point onward.

In an embodiment of significant practical interest, shown in the accompanying figures for the purposes of non-limiting example of the application of the disclosure, and precisely in order to increase the possibility of easy retrieval of objects of various types (while at the same time ensuring an ordered arrangement), the container 1 according to the disclosure comprises at least one drawer 6, which is coupled to the first half-shell 2 (in accordance with the methods that will be described in detail in the following pages) and is completely accommodated in the compartment 4 in a first position for use (such as for example in FIGS. 6, 7, 16 and 17).

Thus in order to allow a user to retrieve objects arranged inside it, the drawer 6 is at least partially extractable (as can clearly be seen from FIGS. 8 and 9) at one or both of the second configuration of the second half-shell 3 and the second arrangement of the door 5.

It must in fact be pointed out that in the embodiments shown in the accompanying figures, the drawer 6 can slide along a substantially horizontal direction (or in any case in a direction perpendicular to the door 5), and thus can be at least partially extracted through the opening 2*b* (when the door 5 is in the second arrangement, and independently of the configuration assumed by the second half-shell 3).

As will be better explained in the following pages, the possibility is not ruled out moreover of providing the container 1 according to the disclosure with one or more drawers 6 which can slide according to a substantially vertical direction (i.e. perpendicular to the ideal resting plane and parallel to the door 5), and thus can be extracted through the mouth delimited by the edge 2*a* of the first half-shell 2 (when the second half-shell 3 is in the second configuration, and independently of the arrangement assumed by the door 5).

In any case, conveniently, the container 1 according to the disclosure comprises means for guiding the sliding of the drawer 6, so as to be able to carry out its controlled extraction from the compartment 4.

In particular, the guiding means comprise at least two mutually facing grooves 7 which are provided inside two second side walls 2*d* of the first half-shell 2, which are mutually facing and contiguous with the first side wall 2*c*.

More specifically, in the preferred embodiment, which is shown in the accompanying figures for the purposes of non-limiting example of the application of the disclosure, the container 1 comprises a plurality of drawers 6, while the guiding means comprise a plurality of grooves 7, which are mutually aligned in pairs.

With further reference to the preferred embodiment, the grooves 7 are provided along respective inner coverings 8, optionally removable, of the second side walls 2*d*.

Furthermore, each groove 7 is distanced from the adjacent groove 7 according to a constant pitch, while each drawer 6 has height substantially corresponding to a multiple of the pitch, so as to enable the accommodation of a selected number of drawers 6 in the compartment 4 (of equal or different sizes, as shown in the accompanying figures), according to a plurality of possible combinations, thus ensuring great versatility and the possibility of reconfiguring the container 1 according to the disclosure at will.

Furthermore, it appears evident that the choice to define the grooves 7 in removable coverings 8 further increases the versatility of the container 1 according to the disclosure, in that simply by substituting the coverings 8 it is possible to vary the pitch at will, and hence the size of the drawers 6 that can be used.

Furthermore, it should be noted that the grooves 7 can be provided (directly on the second walls 2*d* or on the coverings 8) with orientation that is horizontal (as in the accompanying figures) or vertical, thus ensuring the possibility of extracting the drawers 6 through the opening 2*b* or the free edge 2*a* (as already mentioned in the previous pages).

Furthermore, obviously, it is possible to vary the direction of extraction of the drawers 6 at another time, simply by conveniently substituting the coverings 8.

Advantageously, the guiding means are affected by at least one arrestor 9 for arresting the sliding of the drawer 6 (or of the drawers 6), which is automatically actuated upon the reaching, by the drawer 6, of a second position, of partial extraction and corresponding to a stroke of predefined length, thus preventing the complete and accidental involuntary extraction. It should be noted that in such second position (shown in FIG. 9), the drawer 6 makes its contents available to a user for an indefinite time, during an operation of any type: the presence of the arrestor 9 guards against the danger that, during the required activities, the drawer 6 returns accidentally to the first position, or falls to the ground, owing to its complete extraction.

The arrestor 9 is further selectively deactivatable (by the user) in order to restore the first position of the drawer 6 and/or in order to completely extract it.

It should thus be noted that thanks to the complete extraction, the user can if needed transport only the drawer 6, and the objects contained in it, without having to simultaneously move the entire container 1.

This is of undoubted interest in all situations in which, after arriving at the preestablished site with the container 1, for example for installation, maintenance, control activities etc., the user needs to move away from the container 1 (for example in order to work in another room, in a cramped space etc.) while bringing specific kits of utensils or tools (or in any case a predefined quantity thereof) with him/her, in order to then operate as required, without being encumbered or hindered by the need to have to move the entire container 1.

Figure 10:
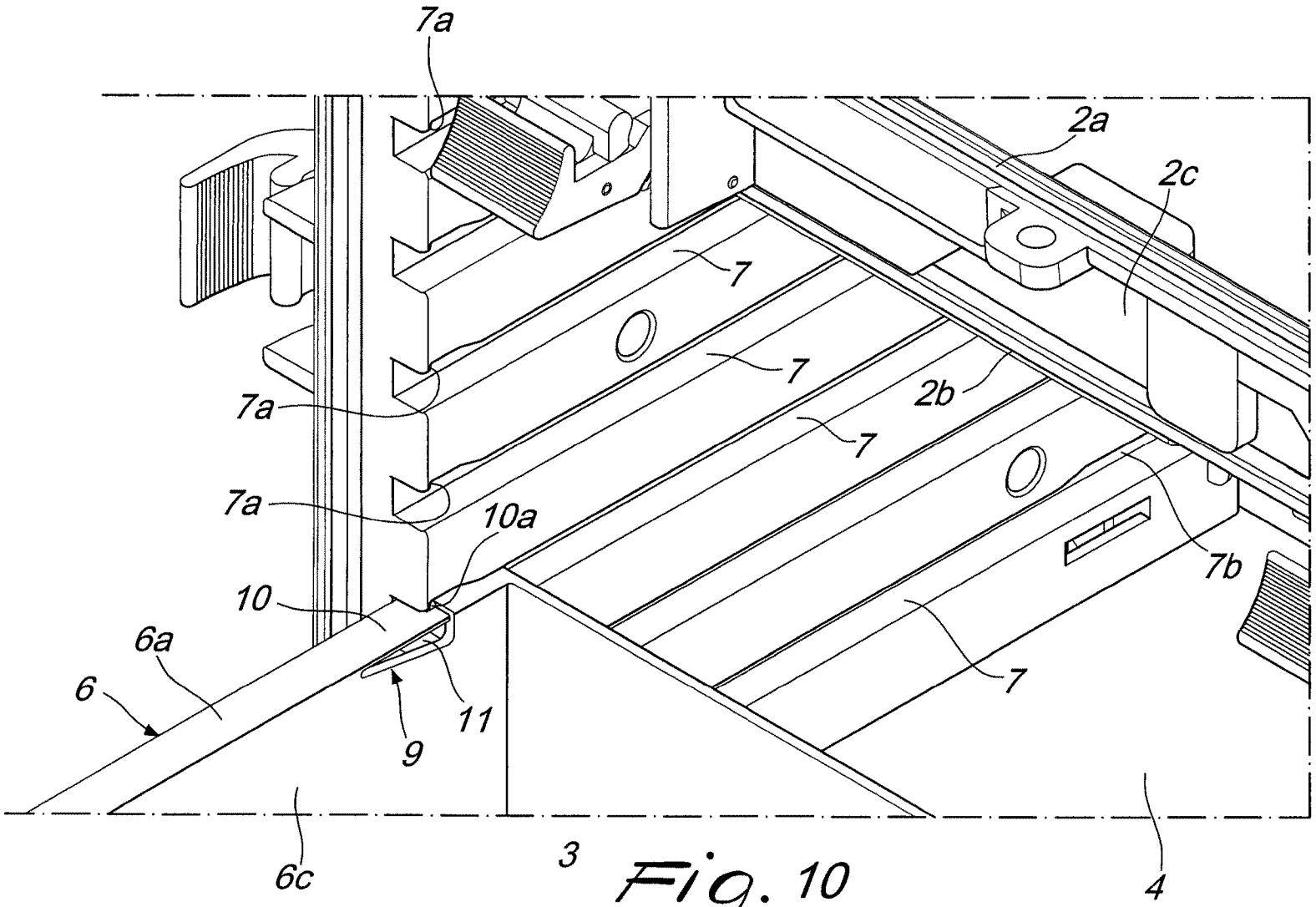
FIG. 10 is a greatly enlarged detail of FIG. 9.
Figure 11:
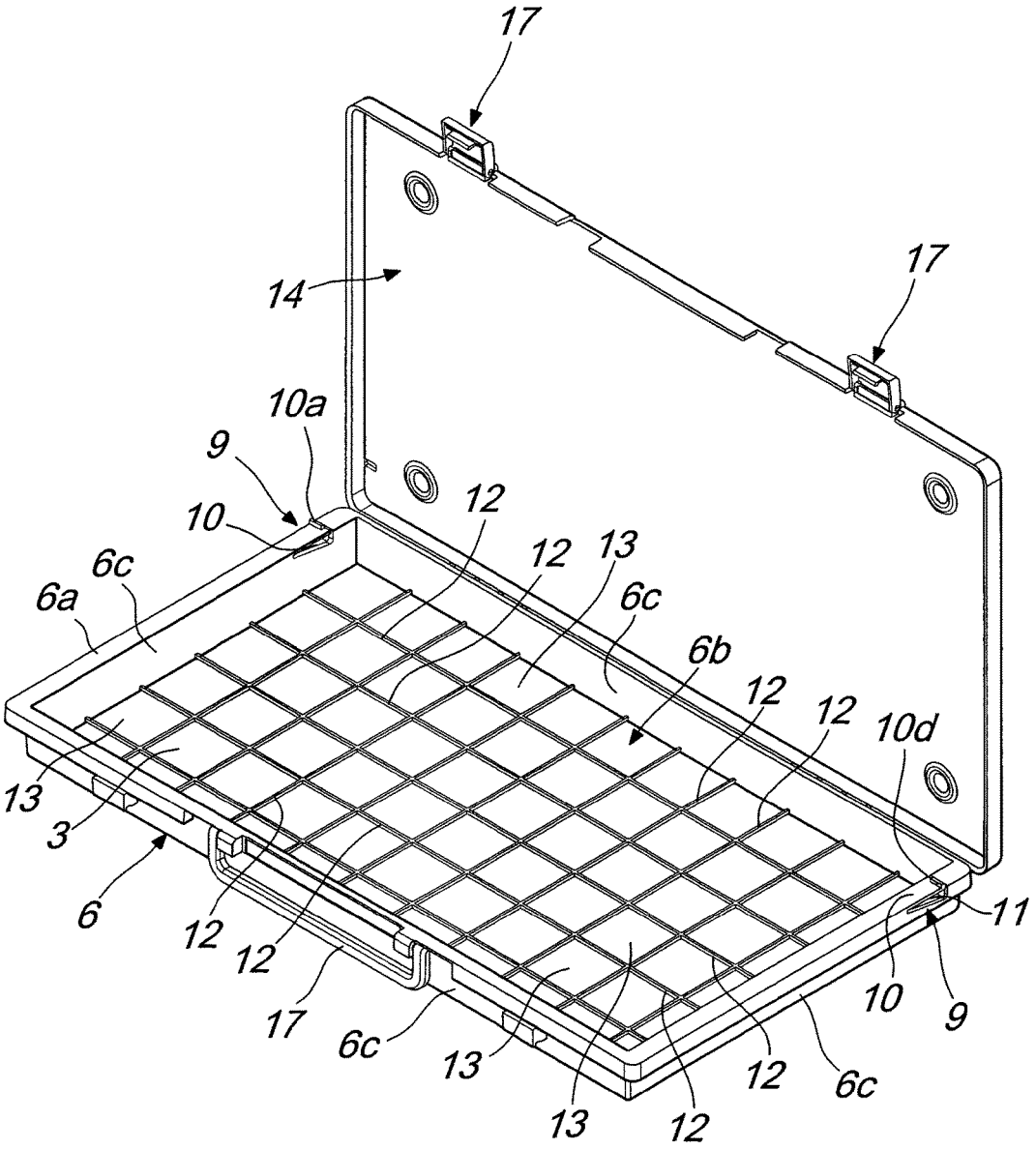
FIG. 11 is a three-quarters perspective front view of some components of the container according to the disclosure.
Figure 12:
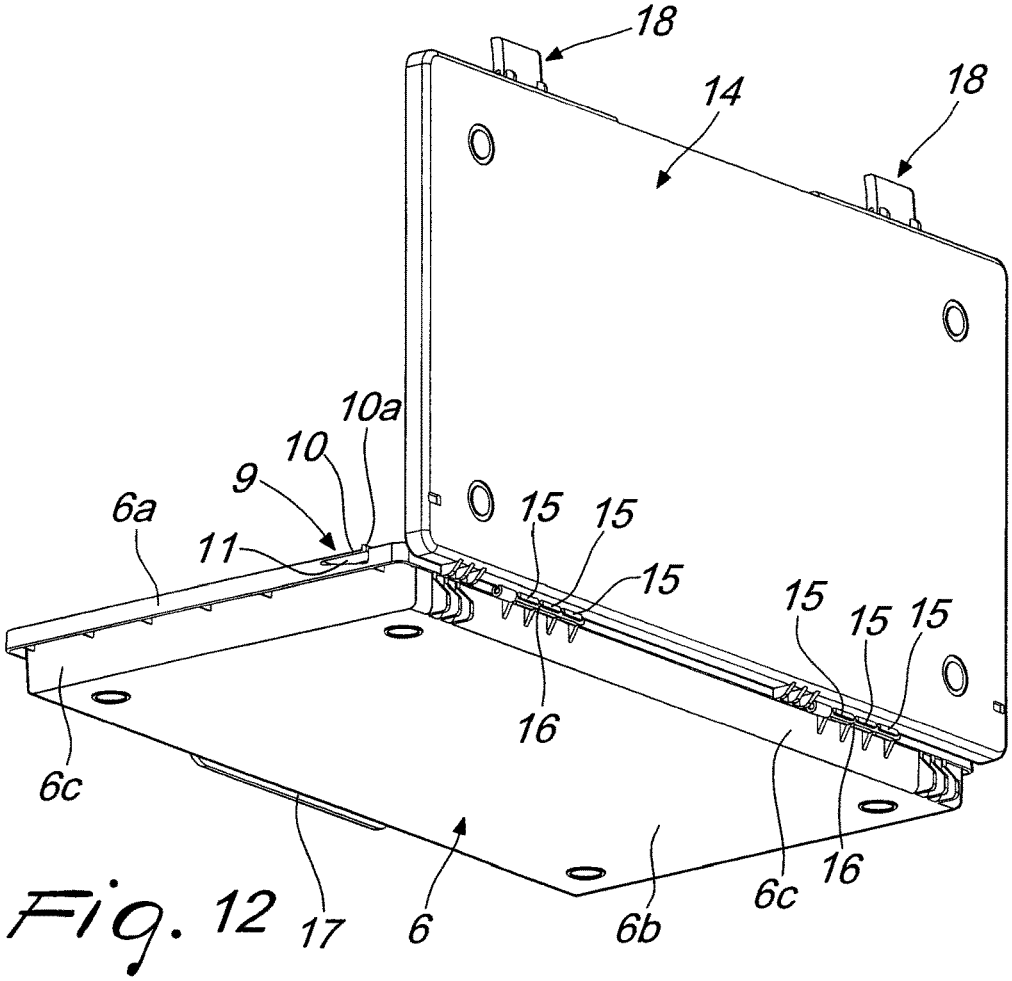
FIGS. 12 and 13 are three-quarters perspective rear views of the reciprocal movement of the components in FIG. 11.

More specifically, as can be seen from FIGS. 10 to 13, each drawer 6 comprises respective mutually opposite protruding lips 6*a*, which are slideably guided along the grooves 7, while the arrestor 9 comprises at least one tab 10 that extends into a recess 11 that is provided along the lip 6*a* and which is normally aligned with the profile of the lip 6*a* (as in FIGS. 10, 11 and 12).

At the previously-introduced second position of the drawer 6 (or of each drawer 6), the respective tab 10 automatically abuts, with an end tooth 10*a* thereof, against an abutment shoulder 7*a* that is provided along the corresponding groove 7, in order to arrest the sliding of the drawer 6 and prevent the complete accidental extraction. By contrast, at the first position of the drawer 6 the tooth 10*a* is accommodated in a contoured recess 7*b*, which is also formed by the corresponding groove 7.

Thus while in the first or the second position, the tooth 10*a* abuts against the abutment shoulder 7*a* or is accommodated in the recess 7*b*, and during the sliding between the first position and the second position, the tab 10 is elastically curved and kept inside the recess 11, so as not to oppose the sliding.

But if a user wants to extract the drawer 6 completely (for example for the purposes described in the preceding pages), he/she can exert a pressure on the tab 10, with the drawer 6 in the second position, so as to determine the distancing of the tooth 10*a* from the abutment shoulder 7*a*, and thus obtain the desired extraction.

In a possible, not exclusive, embodiment, the drawer 6 is constituted substantially by a flat bottom 6*b* and by four sides 6*c*. Furthermore, as can clearly be seen from FIG. 11, the drawer 6 has a plurality of surface ribs 12, which are provided on the inner surface of the flat bottom 6*b* and are distributed in an orderly fashion (for example in a checkerboard pattern, as in the aforementioned FIG. 11), in order to delimit a plurality of receptacles 13 for boxes and beakers, and the like, which in any case are intended to accommodate trinkets and various objects.

In this manner, as appears obvious, it is possible to offer an even more practical and orderly distribution of objects, including small objects, while still ensuring that they are easy to identify even in large containers 1, filled to the brim with utensils and instruments of various types.

Conveniently, the container 1 according to the disclosure comprises at least one cover 14 for at least one drawer 6: the cover 14 can be stably accommodated in the compartment 4 separately from the respective drawer 6 (according to various methods, one of which, illustrated in the accompanying figures, will be described in the present discussion).

Figure 13:
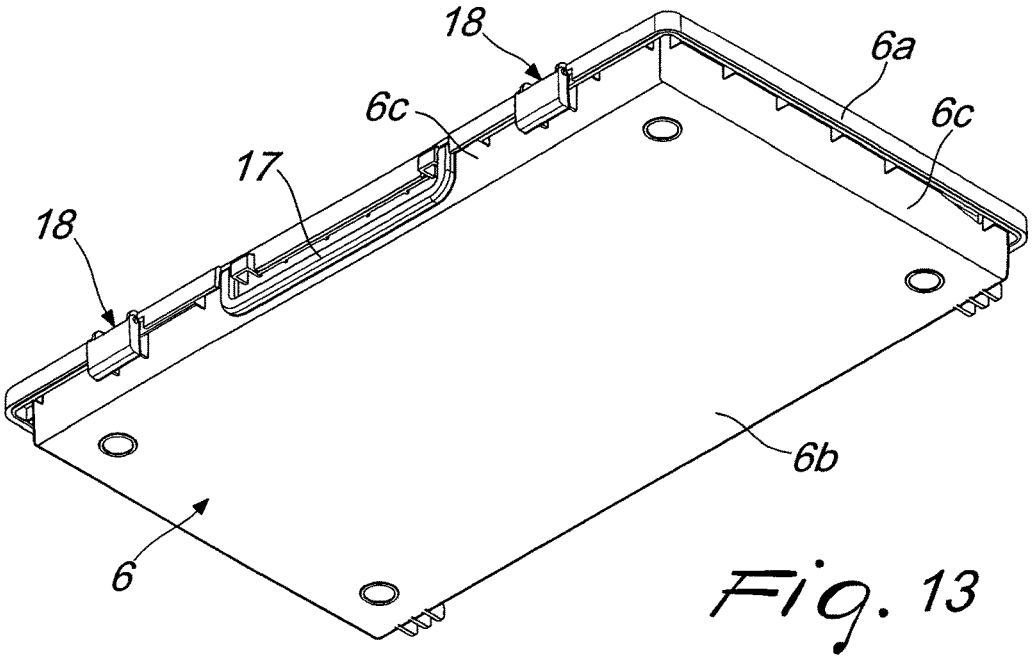

When, for specific application requirements, the drawer 6 is completely extracted from the compartment 4, it is also possible to extract the cover 14 and detachably articulate it to the respective drawer 6, as can be seen for example in FIGS. 11, 12 and 13.

To this end, in the preferred, but not exclusive, embodiment, one of the sides 6*c* of the drawer 6 (or of each drawer 6) externally has at least one substantially cylindrical sleeve 15, which defines a seat for the rotatable and detachable coupling of a corresponding cylindrical pivot 16, which is fixed externally in a cantilever manner to the cover 14.

In this manner, after having extracted, from the container 1, a drawer 6 and, separately, a respective cover 14, the user can articulate the latter to the former simply by inserting the pivot 16 into the respective sleeve 15.

In more detail, in FIG. 12 note how each cover 14 is provided with two triplets of sleeves 15 which are aligned and arranged close together, into which two respective pivots 16 can be rotatably inserted, protruding from the cover 14.

Furthermore the possibility is not ruled out of providing the cover 14 and/or the respective drawer 6 with further useful accessories, such as for example handles 17 and/or devices 18 for locking the cover 14 to the drawer 6, in order to render the use and transport of the drawers 6, without the container 1 according to the disclosure, even more practical.

Conveniently, in the preferred embodiment (which is non-limiting of the application of the disclosure) the first half-shell 2 is substantially box-like; furthermore the base 2*e* of the first half-shell 2 is provided with at least one modular insert 19 that is adapted to be removably mated with a respective supporting unit, which is preferably selected from a foot 20, a wheel 21, and the like.

In cooperation with further accessories, which may be of the conventional type, such as for example a telescopic handle 22 and/or additional wheels 23, the modular inserts 19 offer various methods of support and transport of the container 1 according to the disclosure.

In fact, by securing the feet 20 to the inserts 19, the container 1 can be transported while partially inclining it, so that only the wheels 23 touch the ground, and pulling it by way of the handle 22, extracted from its recess 24 (as with conventional trolley cases). By contrast, when it is not necessary to move the container 1, it can be stably left resting on the ground, on the feet 20.

Alternatively, when it is necessary at all times to ensure that it is possible to move the container 1 (and the large dimensions advise against, or in any case complicate, its partial tilting in order to be able to use the wheels 23), it is sufficient to fix the wheels 21 to the inserts 19, and push the container 1 in a very easy (and not at all strenuous) manner.

Thus again, the choice to equip the container 1 with modular inserts 19, in order to be able to select and substitute at will the supporting unit of the first half-shell 2, increases the versatility of the container 1 according to the disclosure, and the number of modes of use.

Conveniently, either or both of the second half-shell 3 and the door 5 has at least one respective external cylindrical hinge cylindrical 25, which is detachably and rotatably inserted in a corresponding at least partially cylindrical bushing 26, which is fixed externally to the first half-shell 2, for, correspondingly, the detachable articulation of either or both of the second half-shell 3 and the door 5 to the first half-shell 2.

More specifically, in the preferred embodiment, and as is made clear from the accompanying figures, respective hinges 25 protrude externally both from the second half-shell 3 and from the door 5, in order to obtain the detachable articulation with the first half-shell 2, at respective bushings 26.

In addition to ensuring a practical method of movement of the second half-shell 3 (for the transition from the first configuration to the second configuration, and vice versa) and of the door 5 (for the transition from the first arrangement to the second arrangement, and vice versa), the coupling method described above (which is similar to the one described earlier between the drawer 6 and the cover 14) thus enables the easy and complete removal of the second half-shell 3 and/or of the door 5, if necessary.

Conveniently, the compartment 4 is divided into two separate chambers by a deck 27, which is removably arranged parallel to the main face 3*a* of the second half-shell 3, when it is arranged in the first configuration.

Thus it is possible to isolate two distinct areas (the chambers) of the compartment 4, so that a first chamber (and only the first chamber) is accessible through the opening 2*b* when the door 5 is in the second arrangement (and independently of the configuration assumed by the second half-shell 3), while a second chamber (and only the second chamber) is accessible following the transition of the second half-shell 3 to the second configuration (and independently of the arrangement assumed by the door 5).

Therefore, according to specific requirements, it is possible to set up the container 1 so that it defines a single compartment 4 (if the deck 27 is not provided, or is removed), or two separate chambers (which are subdivided by the deck 27).

In the first case, the user can thus have access to the drawers 6 both through the mouth delimited by the free edge 2*a* of the first half-shell 2, and also through the opening 2*b* of the first half-shell 2 itself, while in the second case, the drawers 6 can be accessed only through the opening 2*b*, while the deck 27 can be used for resting further objects thereon (which can be removed through the mouth delimited by the free edge 2*a*).

Moreover, it should be noted that if the user wants to transition from one to the other of the two options explained above, it is sufficient to extract or reinsert the deck 27, in a practical and easy manner. The presence of the deck 27 further makes it possible to confer greater rigidity and solidity on the entire container 1 according to the disclosure.

In order to provide further opportunities for accommodating objects in the compartment 4, which can be taken out through the above mentioned mouth, as an alternative or in addition to the possibility presented by the deck 27, the container 1 according to the disclosure comprises at least one tray 28 which can be removably accommodated in the first half-shell 2 (and optionally provided with further handles 17), at its free edge 2*a* (so in fact, obstructing the mouth defined thereby).

Figure 5:
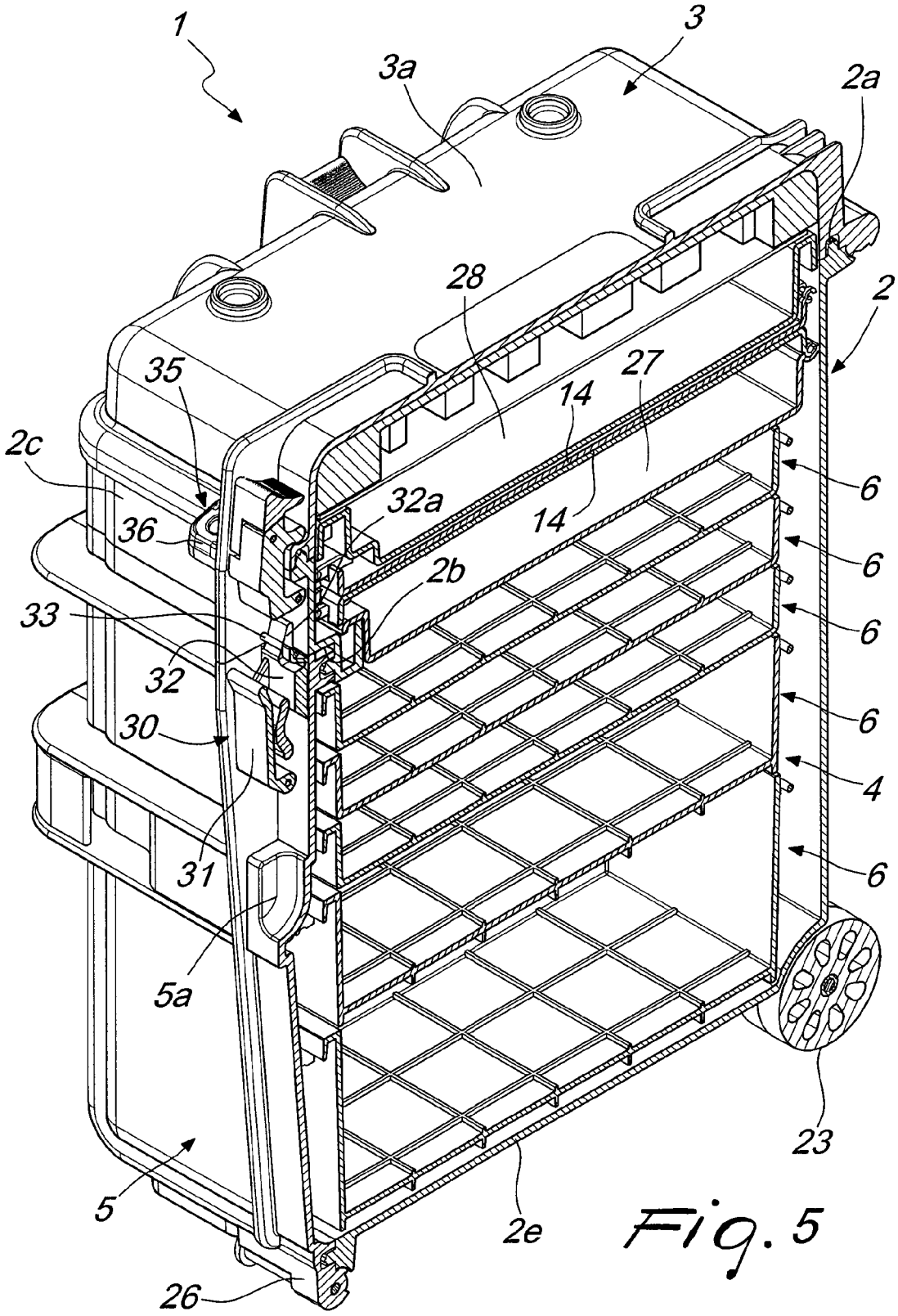
FIG. 5 is a cross-section of the container in FIG. 1, taken along a plane perpendicular to the door and to the ideal resting plane.
Figure 6:
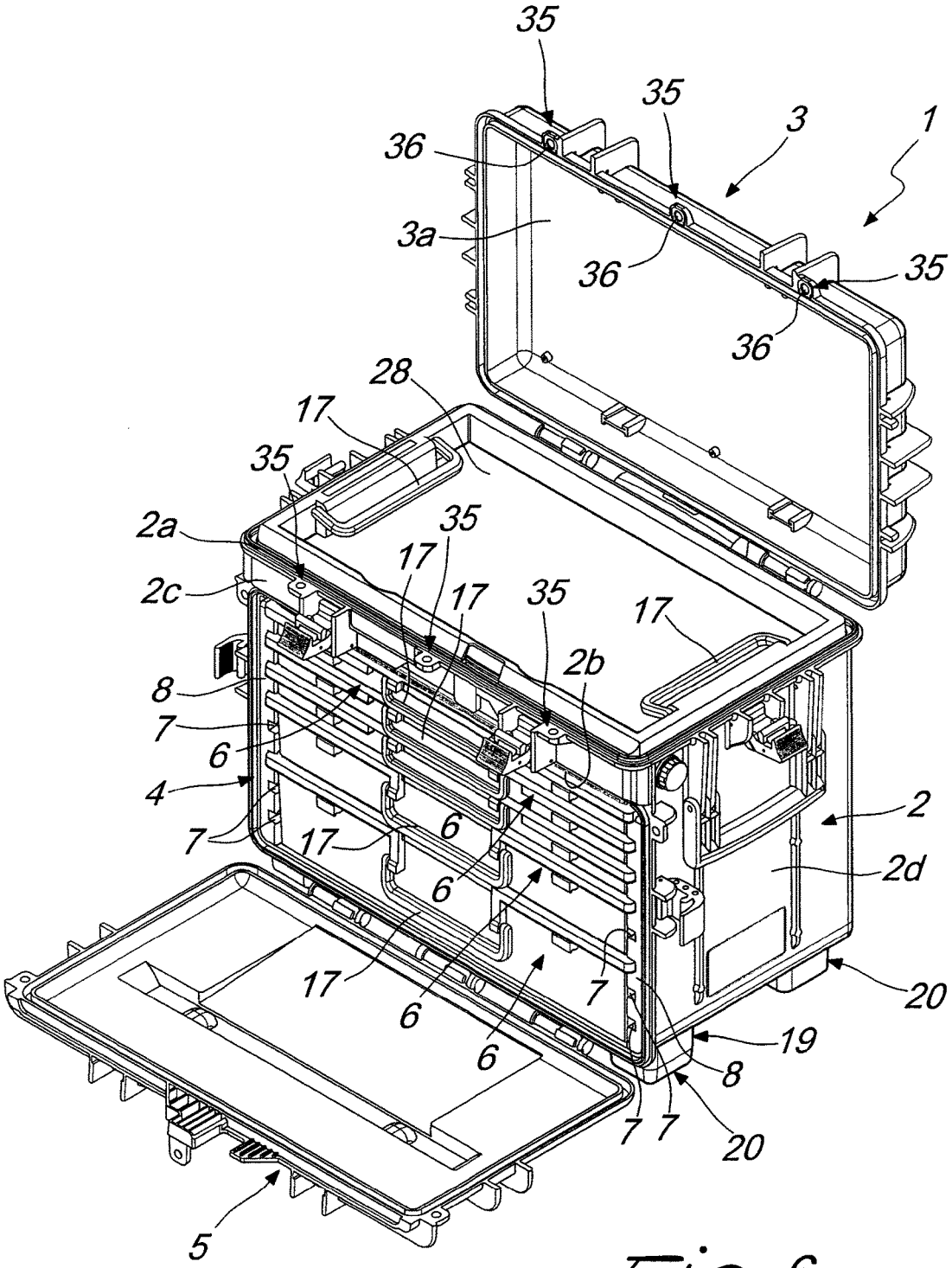
FIG. 6 is a three-quarters perspective front view of the container in FIG. 1, with the second half-shell in the second configuration and the door in the second arrangement.
Figure 7:
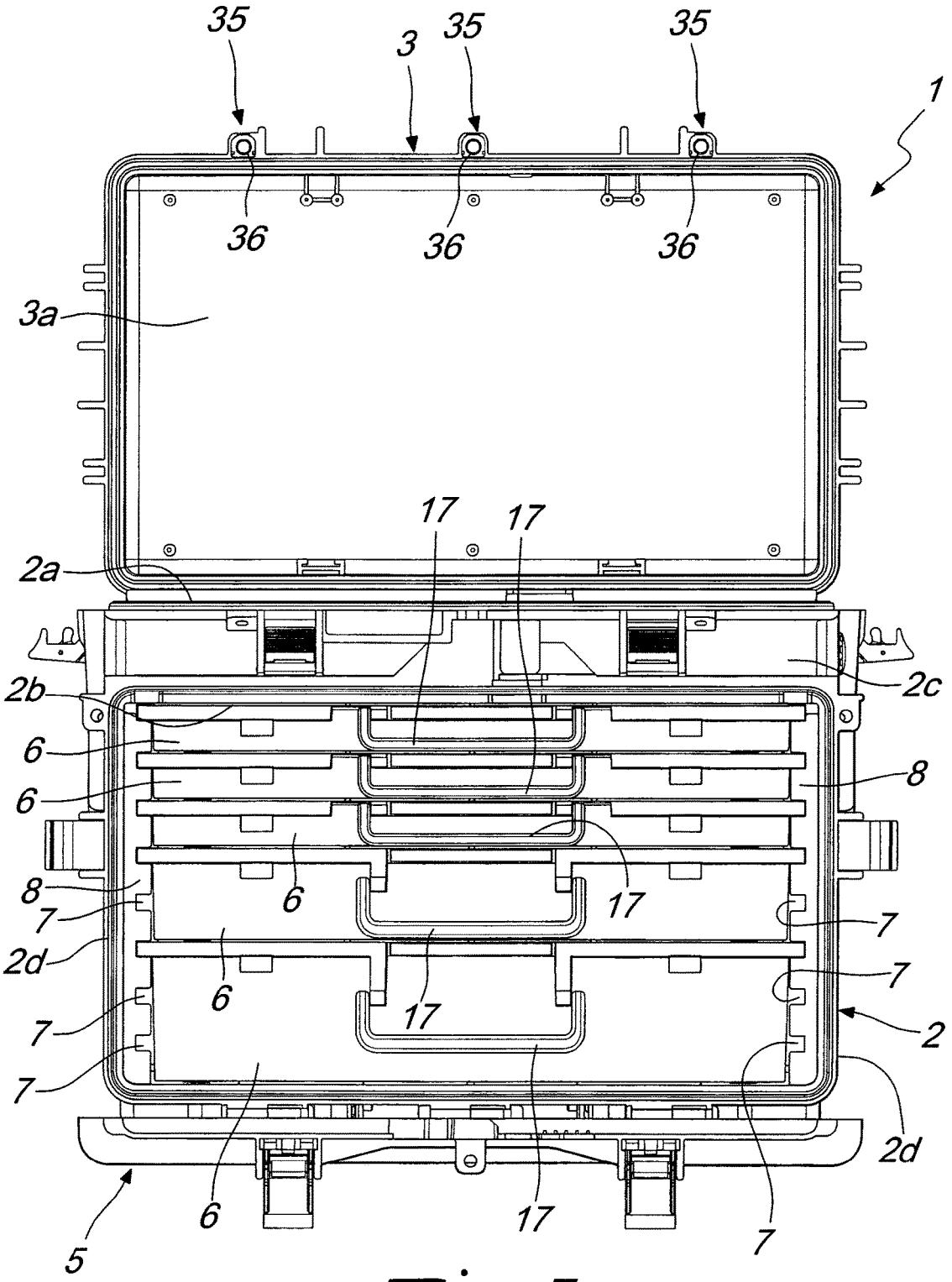
FIG. 7 is a front elevation view of the container in FIG. 6.
Figure 8:
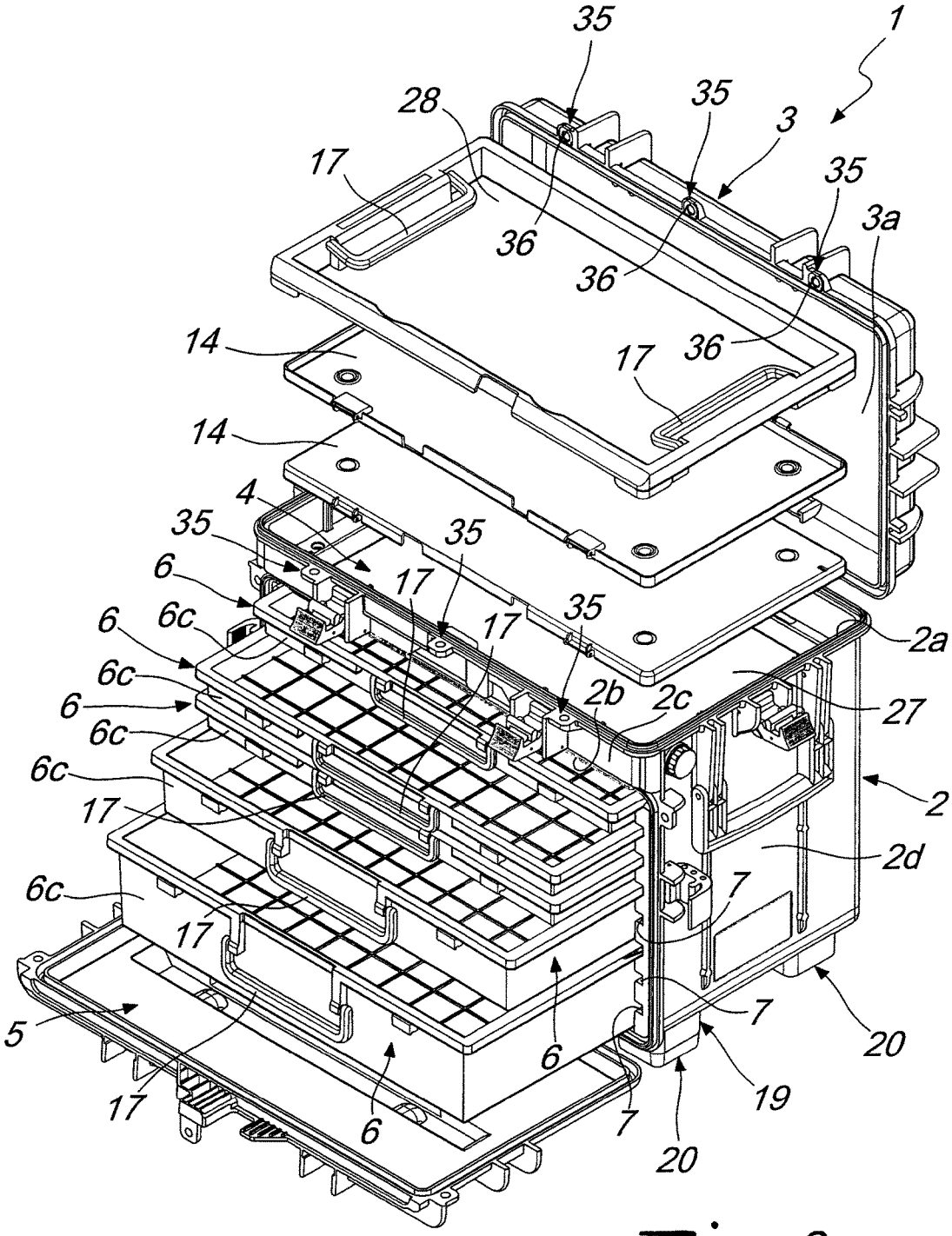
FIG. 8 is a partially exploded, three-quarters perspective front view of the container in FIG. 6.
Figure 9:
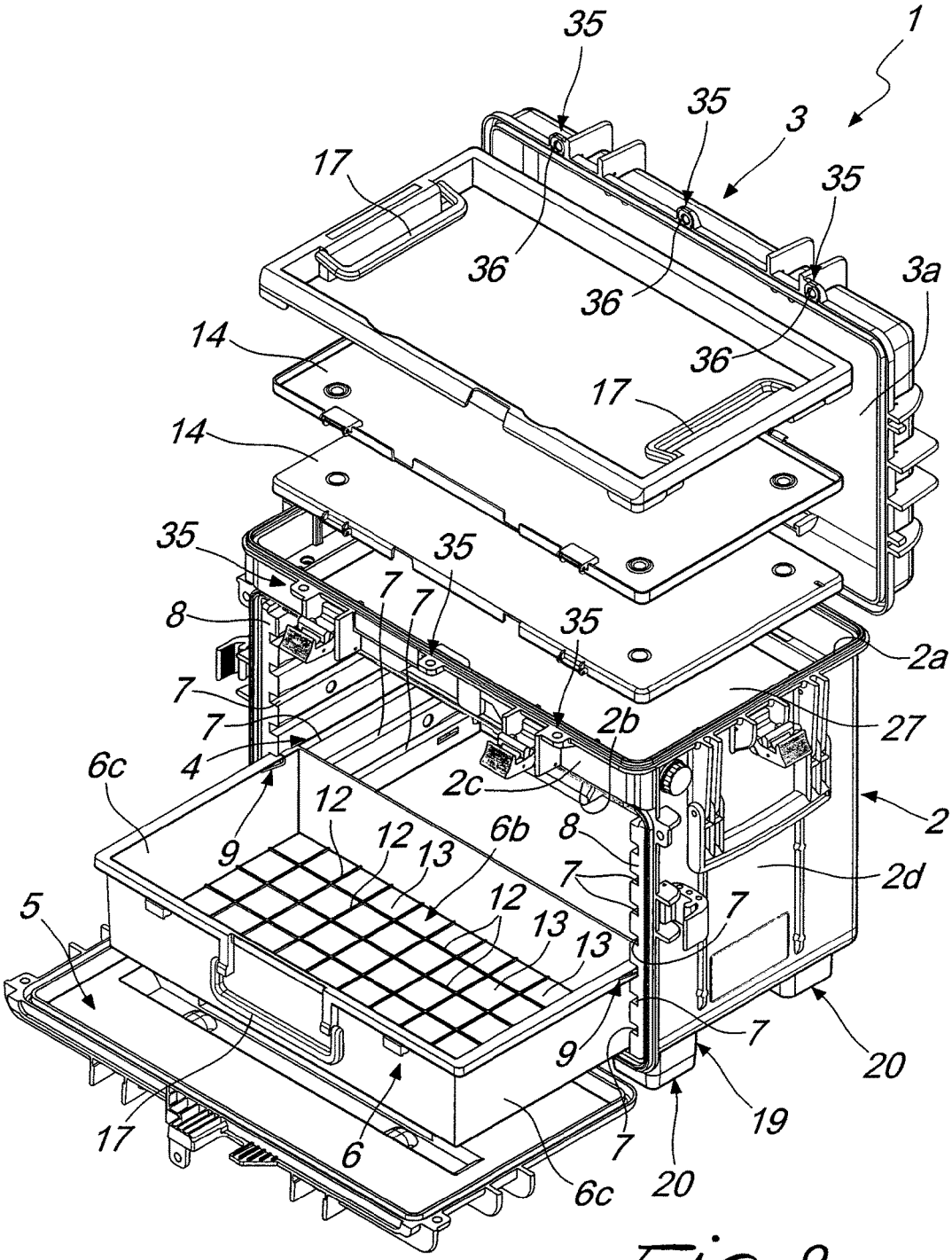
FIG. 9 shows the container in FIG. 8, deprived of some components.

From FIGS. 8 and 9, and from FIG. 5, it is thus evident that, in the preferred embodiment, which is illustrated for the purposes of non-limiting example, the tray 28 and the covers 14 are accommodated, mutually overlapping, in the second chamber defined by the deck 27, while a plurality of drawers 6 can be accommodated in the first chamber.

Moreover, two covers 14 can be accommodated with the respective backs 14*a* substantially facing and proximate, in order to reduce encumbrances.

Advantageously, in some variations of embodiment of undoubted practical interest, the container 1 comprises at least one substantially box-like modular basin 29, which is stably stacked on the first half-shell 2 at its free edge 2*a* and can be closed by the second half-shell 3, in this case uncoupled from the first half-shell 2 itself.

Figure 16:
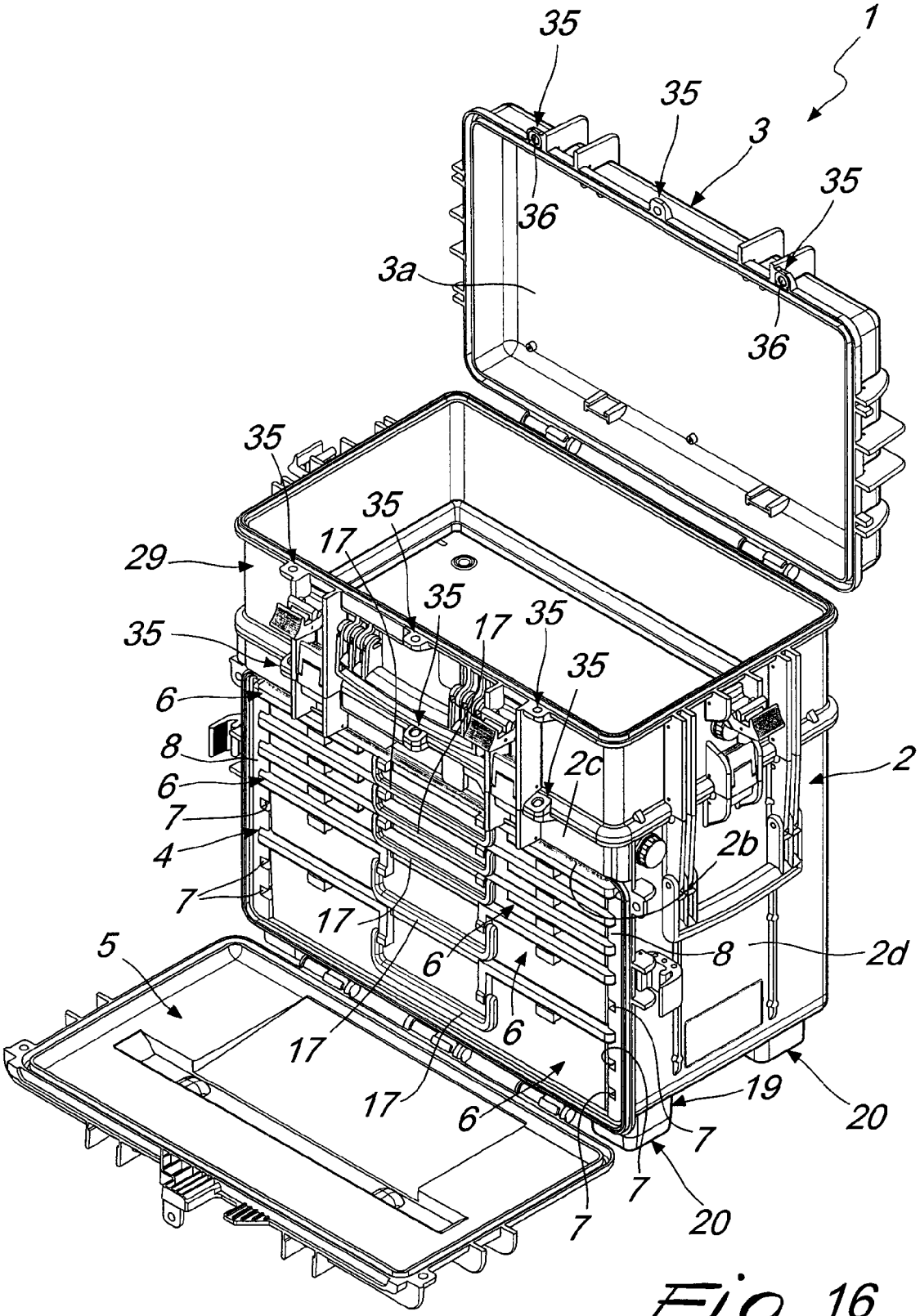
FIG. 16 is a three-quarters perspective front view of the container according to the disclosure in the second embodiment, with the second half-shell in the second configuration and the door in the second arrangement.
Figure 17:
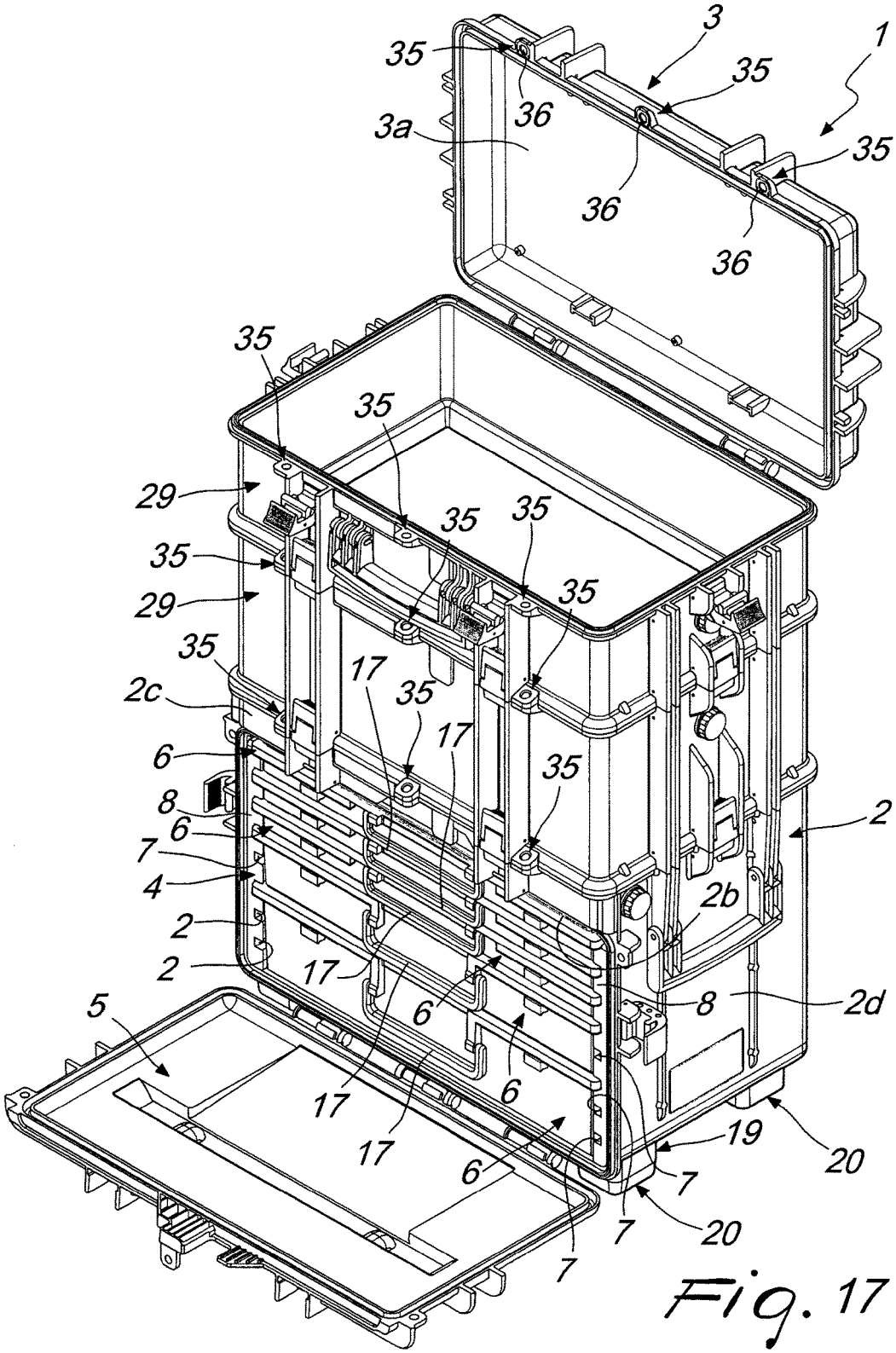
FIG. 17 is a three-quarters perspective front view of the container according to the disclosure in the third embodiment, with the second half-shell in the second configuration and the door in the second arrangement.

In the accompanying FIGS. 16 and 17, two possible variations of embodiment of the container 1 according to the disclosure are thus shown, provided respectively with one and two modular basins 29 (but the possibility is not excluded of using a higher number thereof), so as to be able to increase at will, in a modular manner, the capacity of the compartment 4 (which is optionally divided into various chambers, thanks to the deck 27 and to the bottom of the modular basins 29).

It should be noted that in the variations of embodiment now introduced, it is still possible to use the handle 22 to pull the container 1, and to this end the handle 22 can be dimensioned so that, when it is completely extracted from the recess 24, it still protrudes, with the top thereof, beyond the second half-shell 3, so as to be easily grippable by the user.

The locking of the second half-shell 3 and of the door 5 to the first half-shell 2 can be achieved by using conventional devices and mechanisms. Positively, the container 1 can on the other hand comprise at least one innovative locking assembly 30 with reduced encumbrance (shown in detail in FIGS. 14 and 15), which can be selectively actuated in order to maintain one or both of the first configuration of the second half-shell 3 and the first arrangement of the door 5.

More precisely, in the container 1 shown for the purposes of example in the accompanying figures, two closing assemblies 30 are used to maintain the door 5 in the first arrangement, in cooperation with other conventional locking mechanisms (of which use is also made in order to maintain the first configuration of the second half-shell 3).

Figure 15:
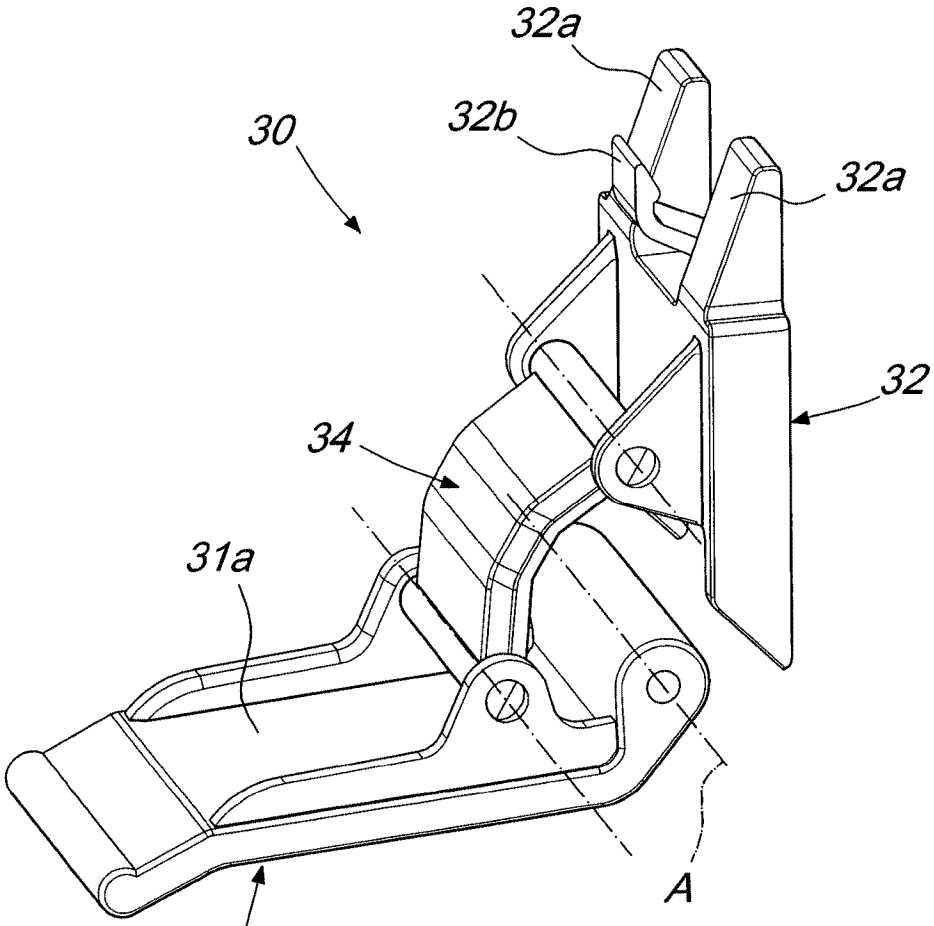
FIGS. 14 and 15 are perspective views of two different configurations of further components of the container according to the disclosure.
Figure 14:
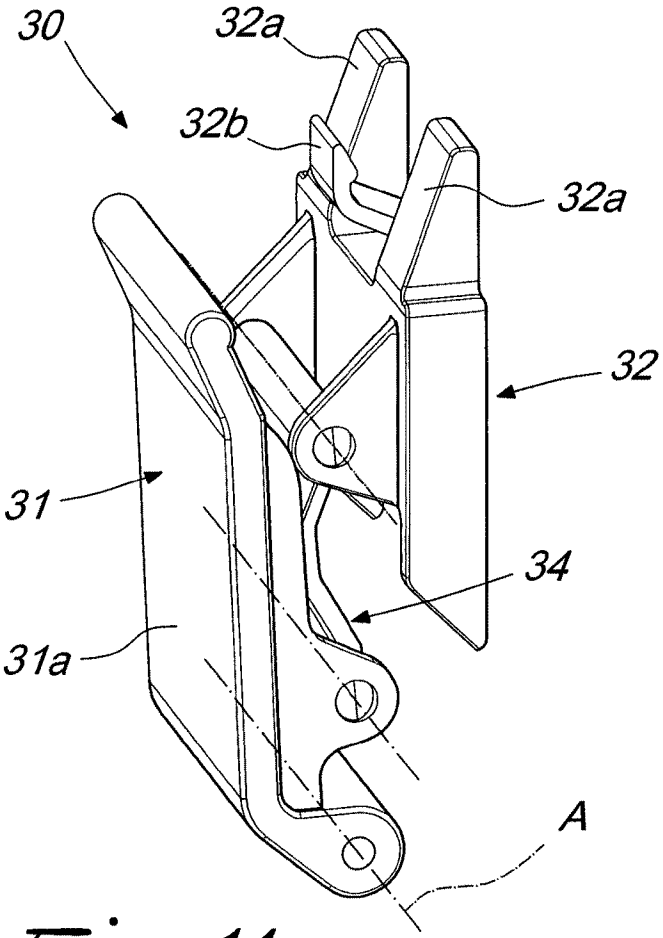

In particular, the locking assembly 30 comprises at least one lever 31 for the actuation of at least one slider 32, which is slidingly coupled to a reference outer surface of the door 5 and can move between at least one first configuration (in which the assembly 30 is shown in FIG. 14) and at least one second configuration (in which the assembly 30 is shown in FIG. 15).

In the first configuration the slider 32 is engaged with a respective abutment 33 that is coupled to the first half-shell 2, for the mutual locking of the door 5 to the first half-shell 2 in the first arrangement, while in the second configuration the slider 32 is distanced from the abutment 33, in order to allow a user to bring the door 5 from the first arrangement to the second arrangement.

More specifically, the slider 32 has at least either or both of an end protrusion comprising at least one surface portion that is inclined, with respect to the direction of movement of the slider 32, so as to define a sort of wedge 32*a*, and an end hook 32*b*.

During the transition of the slider 32 from the second configuration to the first configuration, the wedge 32*a* is slid under the abutment 33, which is constituted by a transverse rod that is rigidly supported by the first half-shell 2, in order to exert a thrust on the rod and force the mutual locking of the half-shell 2 and of the door 5. Furthermore, at least in the first configuration the wedge 32*a* opposes by interference any subsequent transitioning of the door 5 from the first arrangement of use to the second arrangement of use.

Likewise, in the first configuration the hook 32*b* is stably engaged, by elastic deformation, with the respective abutment 33, which is constituted by the transverse rod that is rigidly supported by the first half-shell 2.

Although it is possible to provide containers 1 in which the slider 32 has only the hook 32*b* or only one or more wedges 32*a*, in the preferred embodiment, which is shown in the accompanying figures by way of non-limiting example, the slider 32 comprises an end hook 32*b*, which is interposed between two end protrusions, which are mutually side by side and define respective wedges 32*a*, so as to obtain an optimal locking of the door 5 to the first half-shell 2, by way of the joint action of the two wedges 32*a* and of the hook 32*b*, which all operate in association with the abutment 33, which is constituted by the transverse rod.

In turn, the actuation lever 31 comprises a contoured plate 31*a* that can be articulated, about a first rotation axis A, to the reference outer surface, while the slider 32 is controlled by the lever 31 by way of a respective kinematic mechanism 34 (some sort of bridge for example), for the commanded transitioning from the first configuration to the second configuration, and vice versa, following a rotation, about the first axis, impressed by a user upon the lever 31.

It can thus be seen that one or more closing assemblies 30 ensure the mutual locking of the door 5 and of the first half-shell 2, while at the same time ensuring contained dimensions and space occupation.

In more detail, during the transition from the second configuration to the first configuration, the wedges 32*a* are progressively slid under the abutment 33, and thus begin to press against the latter, in order to mutually lock the door 5 and the first half-shell 2.

When the slider 32 reaches the first configuration, the hook 32*b* engages by elastic deformation with the abutment 33, thus stabilizing the coupling between the door 5 and the first half-shell 2 (together with the action of the wedges 32*a*, which by interference oppose the movement of the door 5) and thus ensuring an optimal locking and closure.

It should further be noted that the slider 32, which has the task of ensuring the mutual locking, can only perform a translational (sliding) motion along the reference outer surface of the door 5.

Therefore, both in the two configurations shown in FIGS. 14 and 15, and also during the transition from the one to the other, and vice versa, the slider 32 protrudes only minimally from the space occupation of the container 1, without thus significantly interfering with the components and accessories of the latter.

It should further be noted that along the door 5, proximate to each lever 31, a respective pit 5*a* is provided which allows the insertion of one or more fingers of the user and thus favors the gripping and actuation of the lever 31 itself, at least for its transition from the first configuration to the second configuration.

Operation of the container according to the disclosure is thus evident from the foregoing description: it in fact offers several different possibilities for the orderly arrangement of objects of various types, while at the same time ensuring methods of retrieval and withdrawal thereof which are very easy.

Through the mouth delimited by the edge 2*a* of the first half-shell 2 (and thus supporting the second half-shell 3 in the second configuration), it is possible in fact to have access to whatever is resting on the tray 28 and on the deck 27, and optionally extract one or more covers 14.

Vice versa, by acting on the door 5, it is possible to partially or completely extract the drawers 6, which in turn are capable of containing tools, trinkets, instruments, and other objects in an orderly manner.

Moreover, the complete extraction of the drawers 6, optionally closed by covers 14, makes it possible for the user to move away from the container 1, taking with him/her only the objects that are strictly necessary for the specific activity required.

In practice it has been found that the container according to the disclosure fully achieves the set aim, in that the choice to equip a first half-shell (which can be closed by a second half-shell) with a door that is arranged to close an opening that is such as to define an additional, independent access to the internal compartment, with the door being able to move, in order to be capable of being at least partially distanced from the opening, makes it possible to arrange the objects accommodated internally in a practical manner.

The disclosure, thus conceived, is susceptible of numerous modifications and variations. Moreover, all the details may be substituted by other, technically equivalent elements.

In the embodiments illustrated, individual characteristics shown in relation to specific examples may in reality be interchanged with other, different characteristics, existing in other embodiments.

For example, the first half-shell 2 and the second half-shell 3 can comprise one or more hasps 35 for padlocks or such contrivances (for example three, as in the embodiments shown in FIGS. 1 to 15).

Figure 2:
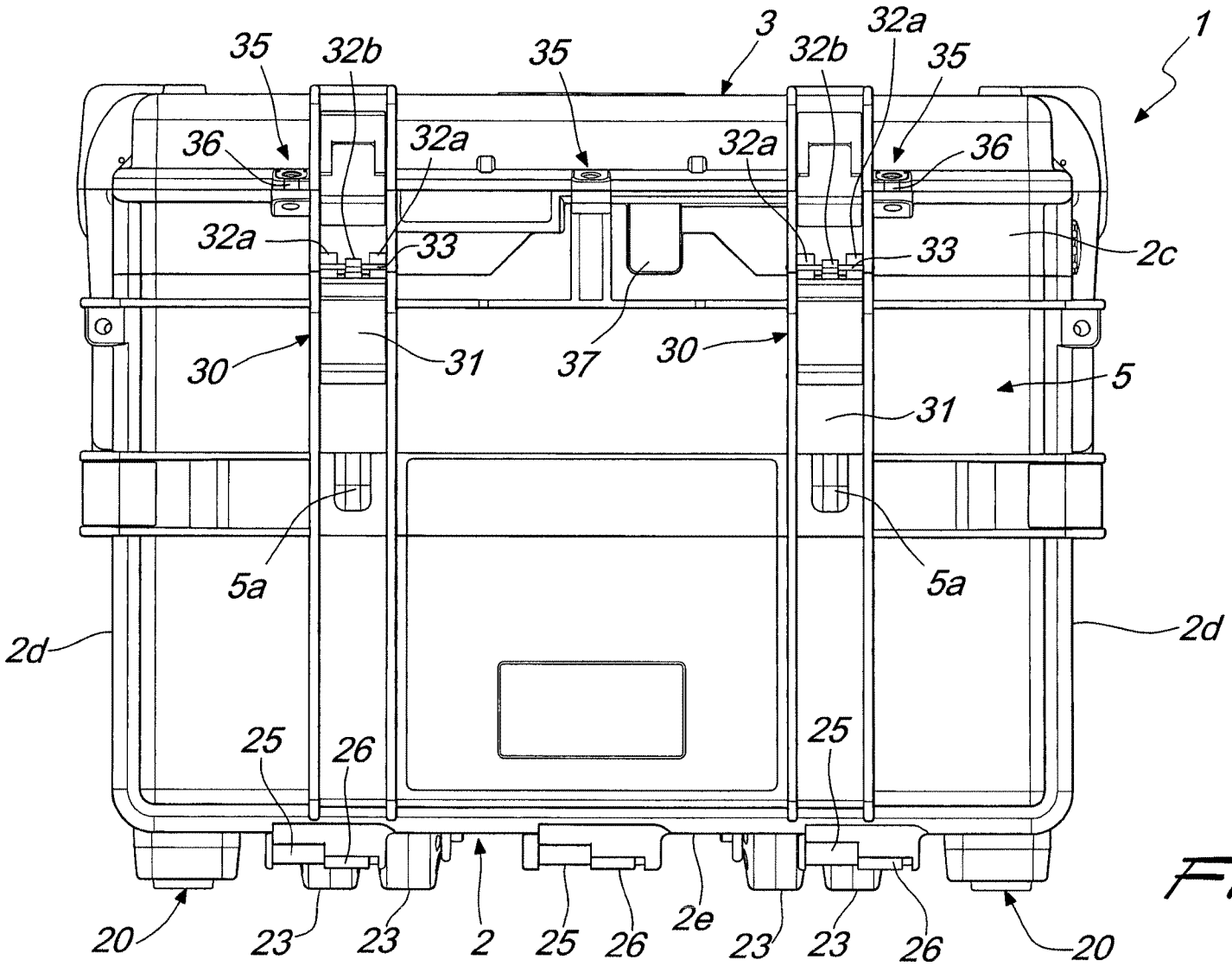
FIG. 2 is a front elevation view of the container in FIG. 1.
Figure 3:
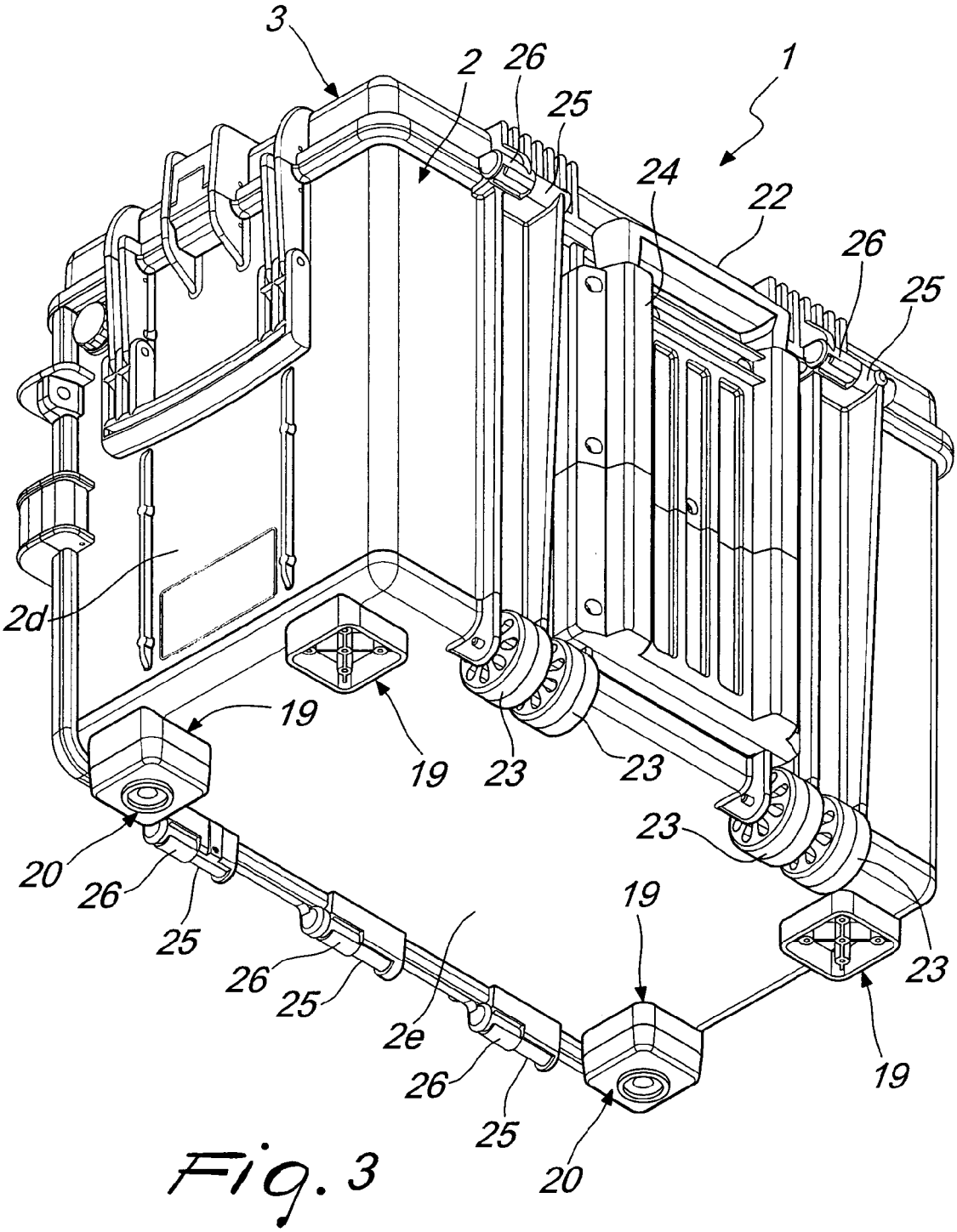
FIGS. 3 and 4 are three-quarters perspective rear views of the container in FIG. 1, with two different types of support.
Figure 4:
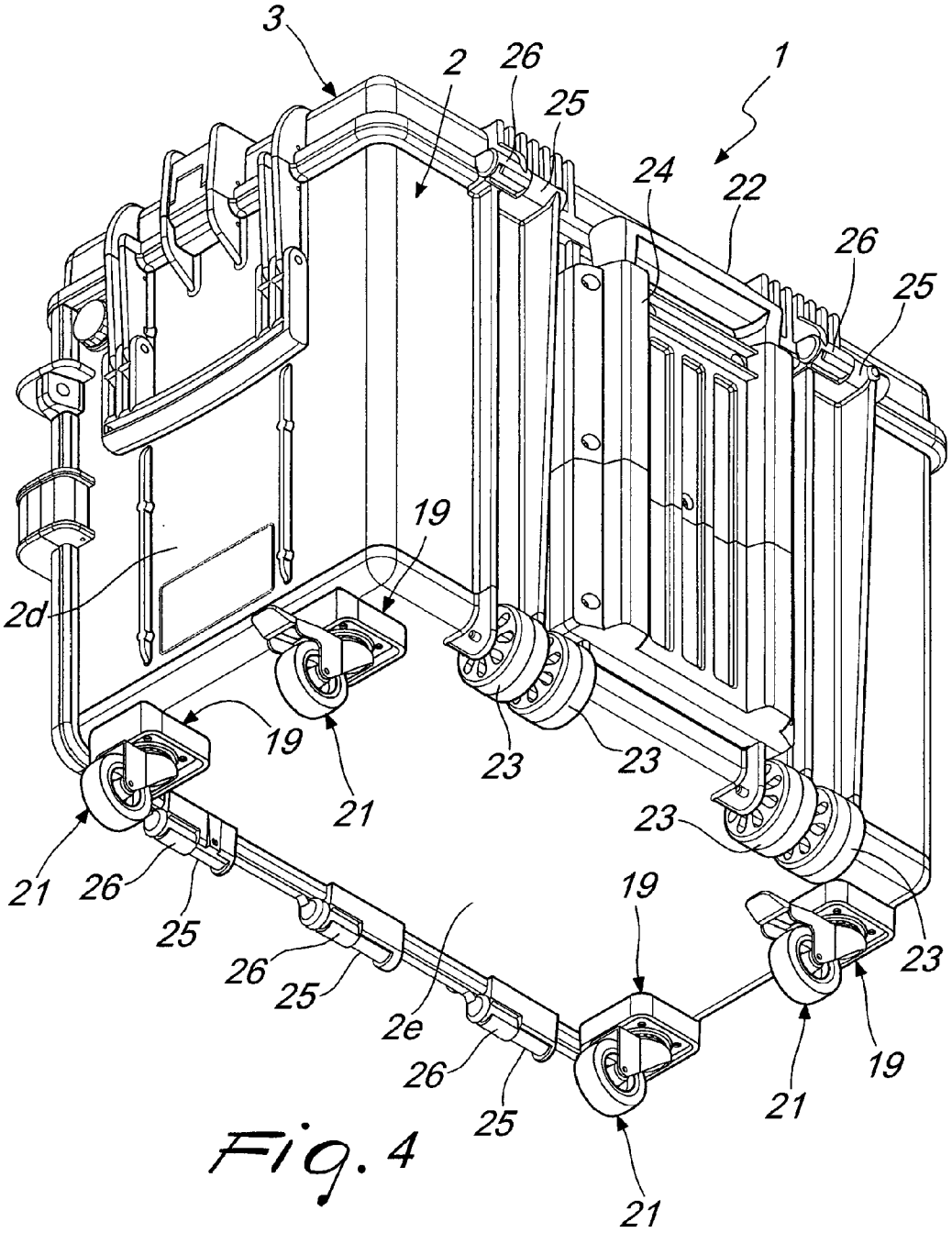

Such hasps 35 can comprise mutually aligned holes provided in tabs that protrude from the half-shells 2 and 3: in the accompanying figures two variations of embodiment in this regard are shown, in one of which such hasps 35 are all provided with metallic stiffening cores 36 (see for example FIGS. 6 and 7), while in the other the central receptacle 35 does not have them (see for example FIGS. 1 and 2).

Furthermore, along the container 1, and for example along the first side wall 2*c* of the first half-shell 2, conveniently adapted flat insets 37 in the variation of embodiment shown in the accompanying figures can be substituted by key-operated locks or air-bleed valves (mechanical or automatic).

In practice, the materials employed, as well as the dimensions, may be any according to requirements and to the state of the art.

The invention claimed is:

1. A container comprising: at least one first half-shell, which can be closed at a free edge thereof by a second half-shell, when the second half-shell is arranged in a first configuration, in order to define an internal compartment configured to accommodate objects, said second half-shell configured to move from said first configuration to at least one second configuration, of free access to said compartment, and vice versa, wherein said first half-shell has a door arranged, in a first arrangement of use, to close an opening that is provided along at least one first side wall of said first half-shell, the opening defines an additional, independent, access to said compartment, said door configured to move between said first arrangement and at least one second arrangement, in which the door is at least partially distanced from said opening, in order to allow free access to the compartment even when said second half-shell is arranged in said first configuration, and said container further comprising at least one drawer, which is coupled to said first half-shell and completely accommodated in said compartment in a first position for use, said at least one drawer being at least partially extractable at one or both of said second configuration of said second half-shell and said second arrangement of said door, further comprising means for guiding the sliding of said at least one drawer, for its controlled extraction from said compartment, wherein said means for guiding are affected by at least one arrestor for arresting the sliding of said at least one drawer, which can automatically be actuated upon the reaching, by said drawer, of a second position, of partial extraction, said at least one arrestor being selectively deactivatable in order to restore said first position of said drawer and/or for the complete extraction of said at least one drawer, wherein said at least one drawer comprises respective mutually opposite protruding lips, which are slidingly guided along said grooves, said at least one arrestor comprising at least one tab that extends into a recess provided along said lip and is normally aligned with the profile of said lip, at said second position of said at least one drawer said tab automatically abutting, with an end tooth thereof, against an abutment shoulder that is provided along a corresponding said groove, in order to arrest the sliding of said at least one drawer; at said first position of said at least one drawer said tooth being accommodated in a contoured recess, formed by said corresponding groove; during the sliding between said first position and said second position of said drawer said tab being elastically curved and kept inside said recess; a pressure from a user on said tab, at said second position, causing the distancing of said tooth from said abutment shoulder for the complete extraction of said at least one drawer.

2. The container according to claim 1, wherein said means for guiding comprise at least two mutually facing grooves provided inside two second side walls of said first half-shell, which are mutually facing and contiguous with said first side wall.

3. The container according to claim 2, further comprising a plurality of said drawers, said means for guiding comprising a plurality of said grooves, which are mutually aligned in pairs and provided along respective inner coverings, optionally removable, of said second side walls, each one of said grooves being distanced from the said adjoining groove according to a constant pitch, each one of said drawers having a height substantially corresponding to a multiple of said pitch, for the accommodation of a selected number of said drawers in said compartment, according to a plurality of possible combinations.

4. The container according to claim 1, wherein said at least one drawer is constituted substantially by a flat bottom and four sides and has a plurality of surface ribs, which are provided on an inner surface of said flat bottom and are distributed in an ordered manner, for delimitation of a plurality of receptacles for boxes and beakers, which are intended to accommodate trinkets and various objects.

5. The container according to claim 4, further comprising at least one cover of said at least one drawer, said at least one cover being stably accommodatable in said compartment separately from said at least one drawer, said at least one cover being extractable from said compartment and detachably articulated to said at least one drawer, after its complete extraction from said compartment.

6. The container according to claim 5, wherein one of said sides of said at least one drawer has externally at least one substantially cylindrical sleeve, which defines at least one seat for the rotatable and detachable coupling of a corresponding cylindrical pivot, which is fixed externally in a cantilever manner to said cover, for the articulation of said at least one cover to said at least one drawer.

7. The container according to claim 1, wherein said first half-shell is substantially box-like, a base of said first half-shell being provided with at least one modular insert that is adapted to be removably mated with a respective supporting unit, selected from a foot, a wheel.

8. The container according to claim 1, wherein at least one of said second half-shell and said door has at least one respective external cylindrical hinge, which is detachably and rotatably inserted in a corresponding at least partially cylindrical bushing fixed externally to said first half-shell, for detachable articulation of said at least one of said second half-shell and said door to said first half-shell.

9. The container according to claim 1, wherein said compartment is divided into two separate chambers by a deck, which is removably arranged parallel to the main face of said second half-shell, when the second half-shell is arranged in said first configuration, a first chamber being accessible through said opening when said door is in said second arrangement, a second chamber being accessible after said second half-shell transitions to said second configuration.

10. The container according to claim 1, further comprising at least one tray which can be removably accommodated in said first half-shell, at said free edge.

11. The container according to claim 5, wherein said tray and said covers are accommodated, mutually overlapping, in a second chamber, a plurality of said drawers being completely accommodatable in a first chamber.

12. The container according to claim 1, further comprising at least one substantially box-like modular basin, which is stably stacked on said first half-shell at said free edge and can be closed by said second half-shell, decoupled from said first half-shell.

13. The container according to claim 1, further comprising at least one locking assembly of reduced encumbrance, which can be selectively actuated in order to maintain at least one of said first configuration of said second half-shell and said first arrangement of said door.

14. The container according to claim 13, wherein said locking assembly, which can be selectively actuated in order to maintain said second arrangement of said door, comprises at least one lever for actuating at least one slider, which is slidingly coupled to a reference outer surface of said door and can move between at least a first configuration, in which the slider is engaged with a respective abutment that is coupled to said first half-shell, in order to mutually lock said door and said first half-shell in said first arrangement, and at least one second configuration, in which said slider is distanced from said abutment, for the transition of said door from the first arrangement to the second arrangement.

15. The container according to claim 14, wherein said slider has at least one of an end protrusion comprising at least one surface portion that is inclined, with respect to the direction of movement of said slider, in order to define a sort of wedge, and an end hook, during the transition of said slider from said second configuration to said first configuration said wedge being slid under said abutment, which is constituted by a transverse rod that is rigidly supported by said first half-shell, in order to exert a thrust on said rod and force the mutual locking of said first half-shell and of said door and in order to oppose by interference any subsequent transition from said first arrangement of use to said second arrangement of use, at said first configuration said hook being stably engaged, by elastic deformation, with said respective abutment, constituted by said rod.

16. The container according to claim 14, wherein said at least one lever comprises a contoured plate that can be articulated, about a first rotation axis, to said reference outer surface, said slider being controlled by said lever by way of a respective kinematic mechanism, for the controlled transition from said first configuration to said second configuration, and vice versa, following a rotation, about said first axis, impressed by a user upon said lever.

* * * * *